US009014597B2

(12) United States Patent
Tomatsu

(10) Patent No.: US 9,014,597 B2
(45) Date of Patent: Apr. 21, 2015

(54) IMAGE FORMING DEVICE HAVING HOLDER POSITIONING ARRANGEMENT

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 273 days.

(21) Appl. No.: 13/411,749

(22) Filed: Mar. 5, 2012

(65) Prior Publication Data

US 2013/0004198 A1 Jan. 3, 2013

(30) Foreign Application Priority Data

Jun. 30, 2011 (JP) ..... 2011-146657

(51) Int. Cl.
*G03G 21/18* (2006.01)
*G03G 21/16* (2006.01)

(52) U.S. Cl.
CPC ..... *G03G 21/1619* (2013.01); *G03G 21/1666* (2013.01); *G03G 2215/0148* (2013.01); *G03G 2221/1636* (2013.01); *G03G 2221/1654* (2013.01); *G03G 2221/1684* (2013.01)

(58) Field of Classification Search
CPC ..... G03G 21/1619; G03G 2221/1684
USPC ..... 399/111–113
See application file for complete search history.

(56) References Cited

U.S. PATENT DOCUMENTS 6,788,321 B2 9/2004 Araki et al.
7,447,467 B2 11/2008 Kamimura et al.
7,580,653 B2 8/2009 Idehara et al.
7,720,413 B2 5/2010 Kamimura et al.
7,778,569 B2 8/2010 Igarashi
7,787,800 B2 8/2010 Mori
7,894,743 B2 2/2011 Tomatsu
8,041,255 B2 10/2011 Igarashi (Continued)

FOREIGN PATENT DOCUMENTS

CN 1442760 A 9/2003
CN 1797230 A 7/2006

(Continued)

OTHER PUBLICATIONS

Non-Final Office Action issued in U.S. Appl. No. 13/411,784 mailed Oct. 30, 2013.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus includes a main frame, a holder and an exposure unit. The holder holds a plurality of photosensitive drums arrayed in a predetermined array direction, and movable in an accommodating direction to be accommodated in the main frame. The holder includes a pair of metal plates each positioned at each axial end portion of each photosensitive drum. Each of the pair of metal plates has a downstream end portion in the accommodating direction provided with a positioning portion. The main frame includes a pair of first side walls, a pair of second side walls, a linking member, and a support portion. Each of the pair of second side walls is fixed to each first side wall and made from a metal. Each second side wall includes a major portion supporting the exposure unit, and an extension portion extending from the major portion toward the photosensitive drum.

8 Claims, 6 Drawing Sheets

(56) References Cited

U.S. PATENT DOCUMENTS

| | | | | |
|---|---|---|---|---|
| 8,064,793 | B2 | 11/2011 | Kamimura et al. | |
| 8,200,120 | B2 | 6/2012 | Sato | |
| 8,265,522 | B2 | 9/2012 | Kamimura et al. | |
| 8,311,448 | B2 | 11/2012 | Hashimoto | |
| 8,358,954 | B2 | 1/2013 | Tanaka | |
| 8,457,520 | B2 | 6/2013 | Kamimura et al. | |
| 8,577,255 | B2 | 11/2013 | Okabe | |
| 8,606,142 | B2 | 12/2013 | Kamimura et al. | |
| 2003/0160856 | A1 | 8/2003 | Araki et al. | |
| 2006/0140673 | A1 | 6/2006 | Kamimura et al. | |
| 2007/0147885 | A1 | 6/2007 | Okabe et al. | |
| 2007/0166073 | A1 | 7/2007 | Idehara et al. | |
| 2008/0002341 | A1 | 1/2008 | Tomatsu | |
| 2008/0025749 | A1 | 1/2008 | Igarashi | |
| 2008/0159772 | A1* | 7/2008 | Koishi et al. | |
| 2008/0181691 | A1 | 7/2008 | Watanabe et al. | |
| 2009/0028602 | A1 | 1/2009 | Kamimura et al. | |
| 2009/0129812 | A1 | 5/2009 | Kawanami et al. | |
| 2009/0169252 | A1 | 7/2009 | Sato | |
| 2009/0324280 | A1* | 12/2009 | Hashimoto | 399/111 |
| 2010/0104326 | A1 | 4/2010 | Tanaka | |
| 2010/0111562 | A1* | 5/2010 | Okabe et al. | 399/112 |
| 2010/0135694 | A1 | 6/2010 | Hashimoto et al. | |
| 2010/0209140 | A1 | 8/2010 | Kamimura et al. | |
| 2010/0260518 | A1 | 10/2010 | Okabe et al. | |
| 2010/0266311 | A1 | 10/2010 | Igarashi | |
| 2011/0052254 | A1 | 3/2011 | Hashimoto | |
| 2012/0027472 | A1 | 2/2012 | Kamimura et al. | |
| 2012/0251163 | A1* | 10/2012 | Tomatsu et al. | |
| 2012/0251172 | A1 | 10/2012 | Hashimoto et al. | |
| 2012/0308273 | A1 | 12/2012 | Kamimura et al. | |
| 2013/0004199 | A1 | 1/2013 | Souda et al. | |
| 2013/0259524 | A1 | 10/2013 | Kamimura et al. | |
| 2014/0105631 | A1 | 4/2014 | Okabe et al. | |
| 2014/0105644 | A1 | 4/2014 | Kamimura et al. | |
| 2014/0105654 | A1 | 4/2014 | Okabe et al. | |

FOREIGN PATENT DOCUMENTS

| | | | |
|---|---|---|---|
| CN | 1892467 | A | 1/2007 |
| CN | 101149578 | A | 3/2008 |
| CN | 101833262 | A | 9/2010 |
| JP | 2007-178657 | | 7/2007 |
| JP | 2008-009262 | | 1/2008 |
| JP | 2008-049659 | A | 3/2008 |
| JP | 2009-128506 | | 6/2009 |
| JP | 2009-157209 | A | 7/2009 |
| JP | 2010-102175 | A | 5/2010 |
| JP | 2011-070154 | A | 4/2011 |

OTHER PUBLICATIONS

CN Notification of First Office Action mailed Jun. 5, 2014, CN Appln. 201210083978.X, English translation.

CN Notification of First Office Action mailed Jun. 5, 2014, CN Appln. No. 201210083972.2, English translation.

Jan. 20, 2015—(JP) Office Action—App 2011-146652, Eng Tran.

Nov. 7, 2014—(US) Notice of Allowance—U.S. Appl. No. 13/411,784.

Nov. 3, 2014—(CN) Decision of Rejection—App 201210083978.X—Eng trans.

Final Office Action received in corresponding U.S. Appl. No. 13/411,784 mailed May 5, 2014.

* cited by examiner

IMAGE FORMING DEVICE HAVING HOLDER POSITIONING ARRANGEMENT

CROSS REFERENCE TO RELATED APPLICATION

This application claims priority from Japanese Patent Application No. 2011-146657 filed Jun. 30, 2011. The entire content of the priority application is incorporated herein by reference. Further, the present application is closely related to the co-pending U.S. patent application Ser. No. 13/411,784 filed on Mar. 5, 2012 (corresponding to basic Japanese Patent Application No. 2011-146652 filed on Jun. 30, 2011.

TECHNICAL FIELD

The present invention relates to an image forming device having a holder that integrally holds a plurality of photosensitive drums

BACKGROUND

A conventional color printer as an image forming device includes a holder that integrally holds a plurality of photosensitive drums, and an exposure unit that exposes the photosensitive drums to light. More specifically, the exposure unit is supported a metal plate frame constituting a main frame, and the position of the exposure unit is fixed relative to the main frame. The holder is positioned below the exposure unit, and front and rear end portions of the holder are supported to the metal plate frame, so that the position of the holder is fixed relative to the main frame. The exposure unit and the holder are subjected to positioning by the metal plate frame thereby providing an accurate positional relationship between the exposure unit and the holder.

SUMMARY

The inventor of the present invention founds that the metal plate frame must be formed so as to encompass entire areas of the exposure unit and the holder as viewed in an axial direction of the photosensitive drum, because the metal plate frame must support the front and rear end portions of the holder while also supporting the exposure unit. Thus, a compact metal plate frame cannot be realized, to avoid cost reduction.

It is therefore an object of the present invention to provide an image forming apparatus. The image forming apparatus includes a main frame, a holder and an exposure unit. The holder holds a plurality of photosensitive drums arrayed in a predetermined array direction, and movable in an accommodating direction parallel to the array direction to be accommodated in the main frame. The holder includes a pair of metal plates each positioned at each axial end portion of each photosensitive drum. Each of the pair of metal plates has a downstream end portion in the accommodating direction provided with a positioning portion. The exposure unit is configured to expose the plurality of photosensitive drums to light. The main frame includes a pair of first side walls, a pair of second side walls, a linking member, and a support portion. The pair of first side walls is made from a resin and positioned outward of the pair of metal plates in an axial direction of the photosensitive drum in a state where the holder is at its accommodated position. Each of the pair of second side walls is fixed to each first side wall and made from a metal. Each second side wall includes a major portion supporting the exposure unit, and an extension portion extending from the major portion toward the photosensitive drum. The linking member links the pair of second side walls to each other, and is configured to be in contact with the positioning portion from below and on a downstream side of the positioning portion in the accommodating direction. The pair of first side walls has a support portion configured to be in contact with the pair of metal plates from beneath the pair of metal plates at the upstream side of the linking member in the accommodating direction. When the linking member is in contact with the positioning portion and the support portion is in contact with the metal plate, the holder is fixed relative to the main frame.

According to another aspect, the present invention provides an image forming apparatus. The image forming apparatus includes a main frame and a holder. The main frame includes a first side wall, a second side wall fixed to the first side wall and a linking member linked to the first side wall. The second side wall has a support portion and the linking member has a contact portion. The holder holds a photosensitive drum and is configured to move from an outside position outside the main frame to an inside position within the main frame in an accommodating direction. The holder includes a metal plate disposed adjacent to an axial end of the photosensitive drum and extending in the accommodating direction. The metal plate has a positioning portion disposed adjacent to a downstream end of the metal plate in the accommodating direction. The positioning portion is configured to make contact with the contact portion of the linking member for positioning the metal plate relative to the first side wall. The metal plate is configured to make contact with the support portion for positioning the metal plate relative to the second side wall.

BRIEF DESCRIPTION OF THE DRAWINGS

In the drawings;

FIG. 5(*b*) is a partial enlarged side view showing the pin and the holder when the holder is completely accommodated in the main frame in the color printer according to the embodiment.

DETAILED DESCRIPTION

A color printer as an image forming apparatus according to an embodiment of the present invention will be described with reference to FIGS. 1 through 6. Throughout the specification, the terms "upward", "downward", "upper", "lower", "above", "below", "beneath", "right", "left", "front", "rear" and the like will be used assuming that the color printer is disposed in an orientation in which it is intended to be used.

Figure 1:
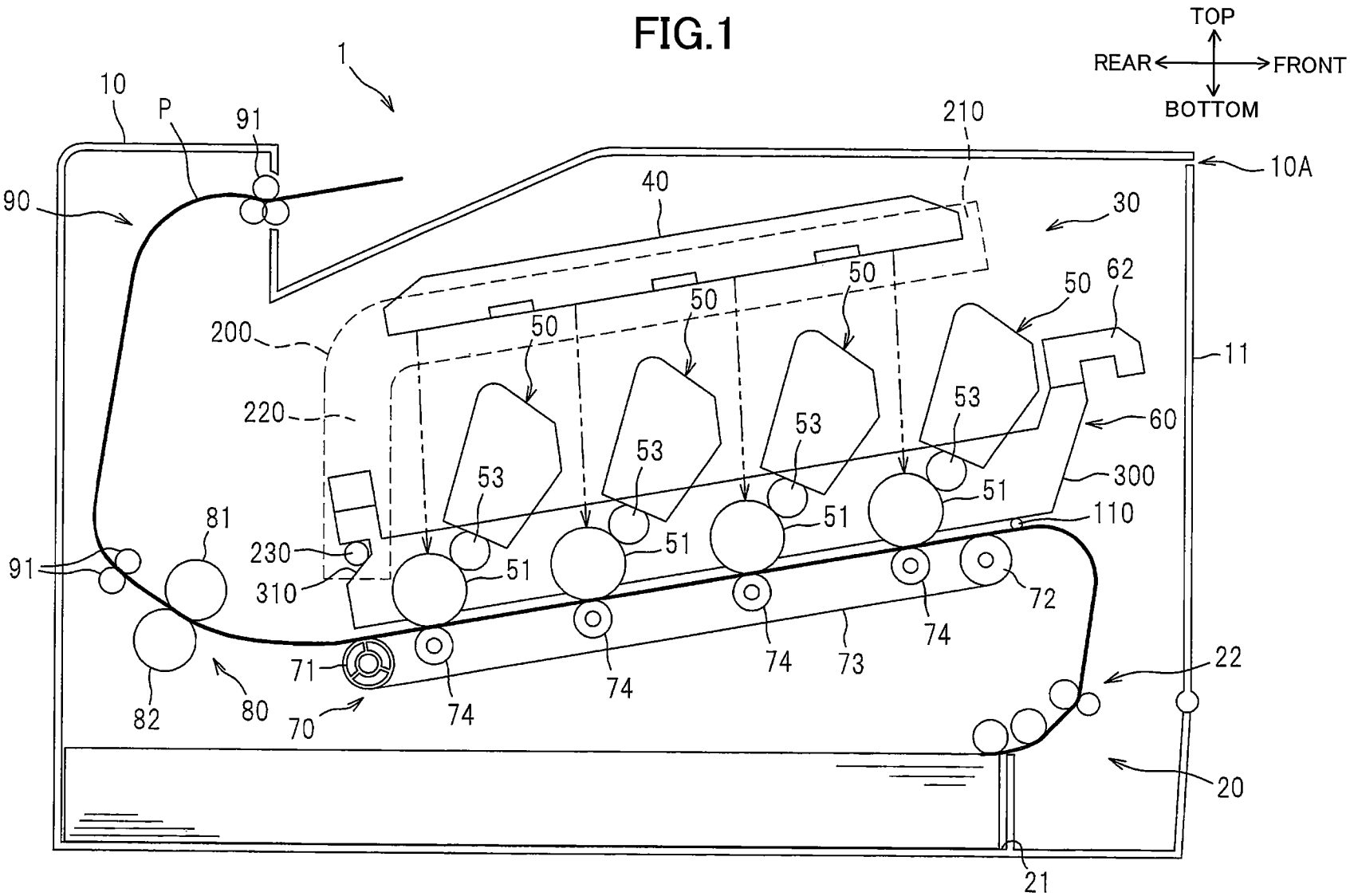
FIG. 1 is a schematic cross-sectional side view of a color printer according to one embodiment of the present invention.

More specifically, in FIG. 1 a right side and a left side are a front side and a rear side, respectively.

The color printer 1 includes a main frame 10 in which a sheet feed unit 20 for feeding a sheet P, an image forming unit 30 for forming an image on the sheet P fed by the sheet feed unit 20, and a sheet discharge unit 90 for discharging an image carrying sheet P are provided. The main frame 10 has a front opening 10A at which a front cover 11 is pivotally movably provided.

The sheet feed unit 20 includes a sheet tray 21 for accommodating a stack of sheets P, and a sheet conveying mechanism 22 for conveying a sheet from the sheet tray 21 to the image forming unit 30.

Figure 4:
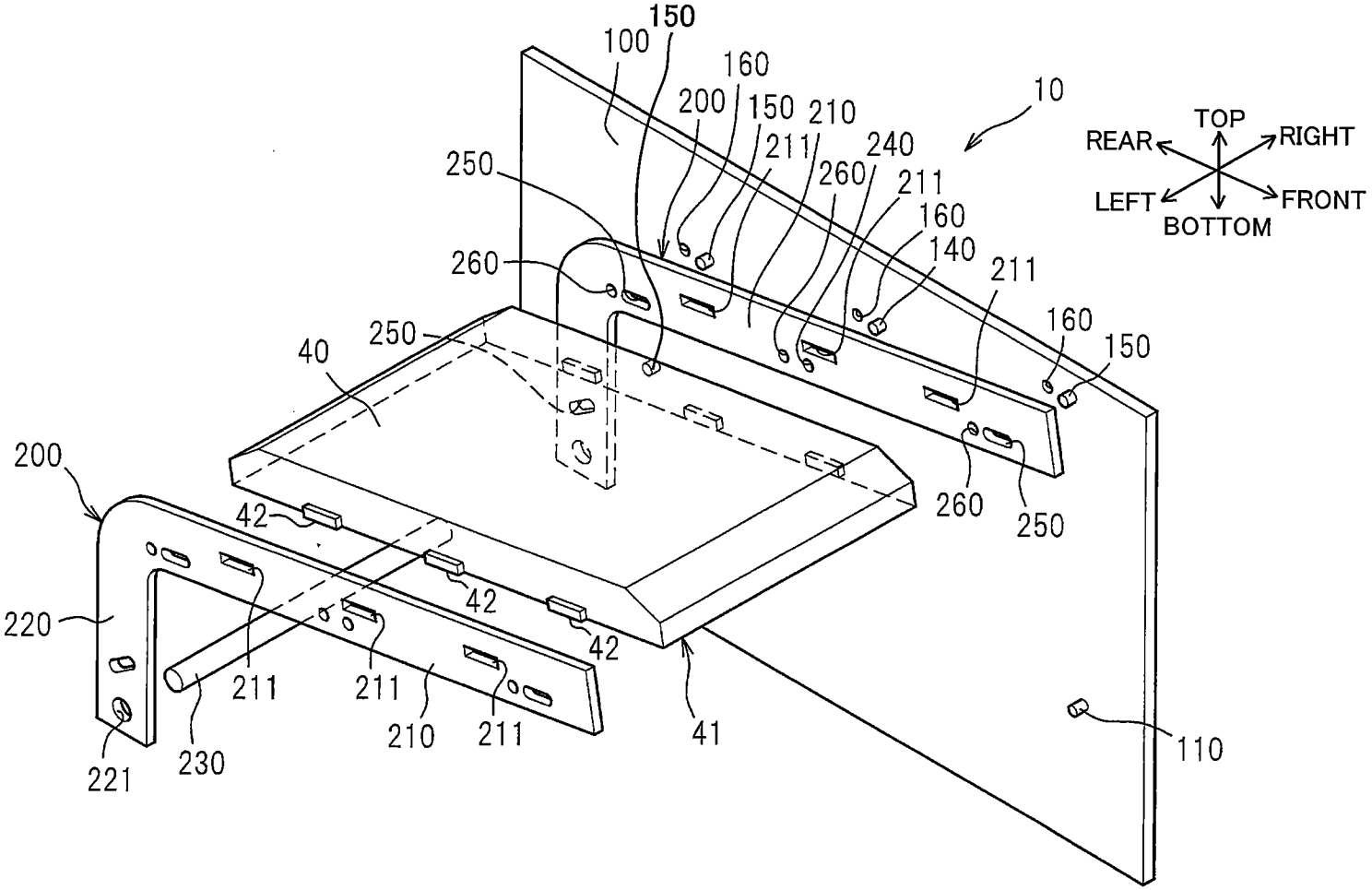
FIG. 4 is a perspective view showing a scanner unit, a resin frame, a metal plate frame, pin and shaft in the color printer according to the embodiment.

The image forming unit 30 includes a scanner unit 40 as an exposure unit, four process cartridges 50, a holder 60, a transfer unit 70, and a fixing unit 80. The scanner unit 40 is provided at an upper portion in the main frame 10, and is provided with a laser emitting portion, polygon mirror, a lens, and a reflection mirror those not shown. High speed scanning is performed such that each laser beam can be irradiated on each surface of each photosensitive drum 51 from the scanner unit 40 as indicated by two dotted chain line in FIG. 1. Further, as shown in FIG. 4, the scanner unit 40 has a casing 41 whose right side wall and a left side wall are respectively provided with three protrusions 42 protruding laterally outward and arrayed in a frontward/rearward direction.

In FIG. 1, the process cartridge 50 are positioned above the sheet feed unit 20 and are arrayed in a predetermined direction, i.e., frontward/rearward direction. Each process cartridge 50 includes the photosensitive drum 51, a charger (not shown), a developing roller 53, and a toner container.

The holder 60 integrally holds four process cartridges 50, and is movable relative to the main frame 10 along a conveyer belt 73 (described later). The holder 60 is accommodated in the main frame 10 by opening the front cover 11 and moving the holder 60 rearward through the opening 10A. In the following description, moving direction of the holder for accommodating the holder into the main frame 10 will be simply referred to as "accommodating direction".

The transfer unit 70 is positioned between the sheet supply unit 20 and the four process cartridges 50, and includes a drive roller 71, a driven roller 72, and the conveyer belt 73 as a belt, and transfer rollers 74. The drive roller 71 and the driven roller 72 are spaced away from each other in the frontward/rearward direction and extend in a direction parallel to each other. The conveyer belt 73 such as an endless belt is mounted under tension between the drive and driven rollers 71 and 72. More specifically, the drive roller 71 is positioned rearward and downward of the driven roller 72, such that the conveyer belt 73 is oriented diagonally downward and rearward in the accommodating direction.

Four transfer rollers 74 are positioned at an internal space defined by the conveyer belt 73 at positions corresponding to four photosensitive drums 51. Each transfer roller 74 and each photosensitive drum 51 nip the conveyer belt 73. A transfer bias is applied to each transfer roller 74 by a constant current control for image transfer from the photosensitive drum 51 to the sheet P.

The fixing unit 80 is positioned rearward of the process cartridges 50 and the transfer unit 70, and includes a heat roller 81 and a pressure roller 82 in confrontation with the heat roller 81 for pressing the same.

In the image forming unit 30, each surface of each photosensitive drum 51 is uniformly charged by the charger, and then, is exposed to light by the scanner unit 40, so that potential at the exposed area is lowered to form an electrostatic latent image based on image data on the surface of the photosensitive drum 51. Then, toner in the toner container is supplied to the photosensitive drum by the developing roller 53 to form a toner image on the surface of the photosensitive drum 51.

Then, the toner image on the photosensitive drum 51 is transferred onto a sheet P when the sheet P on the conveyer belt 73 passes through and between the photosensitive drum 51 and the transfer roller 74. Then, toner image on the sheet P is thermally fixed when the sheet P passes through and between the heat roller 81 and the pressure roller 82.

The discharge unit 90 includes a plurality of conveyer rollers 91 for conveying the sheet P. The sheet P with the fixed image is conveyed by the conveyer rollers 91 and is discharged outside of the main frame 10.

Figure 3:
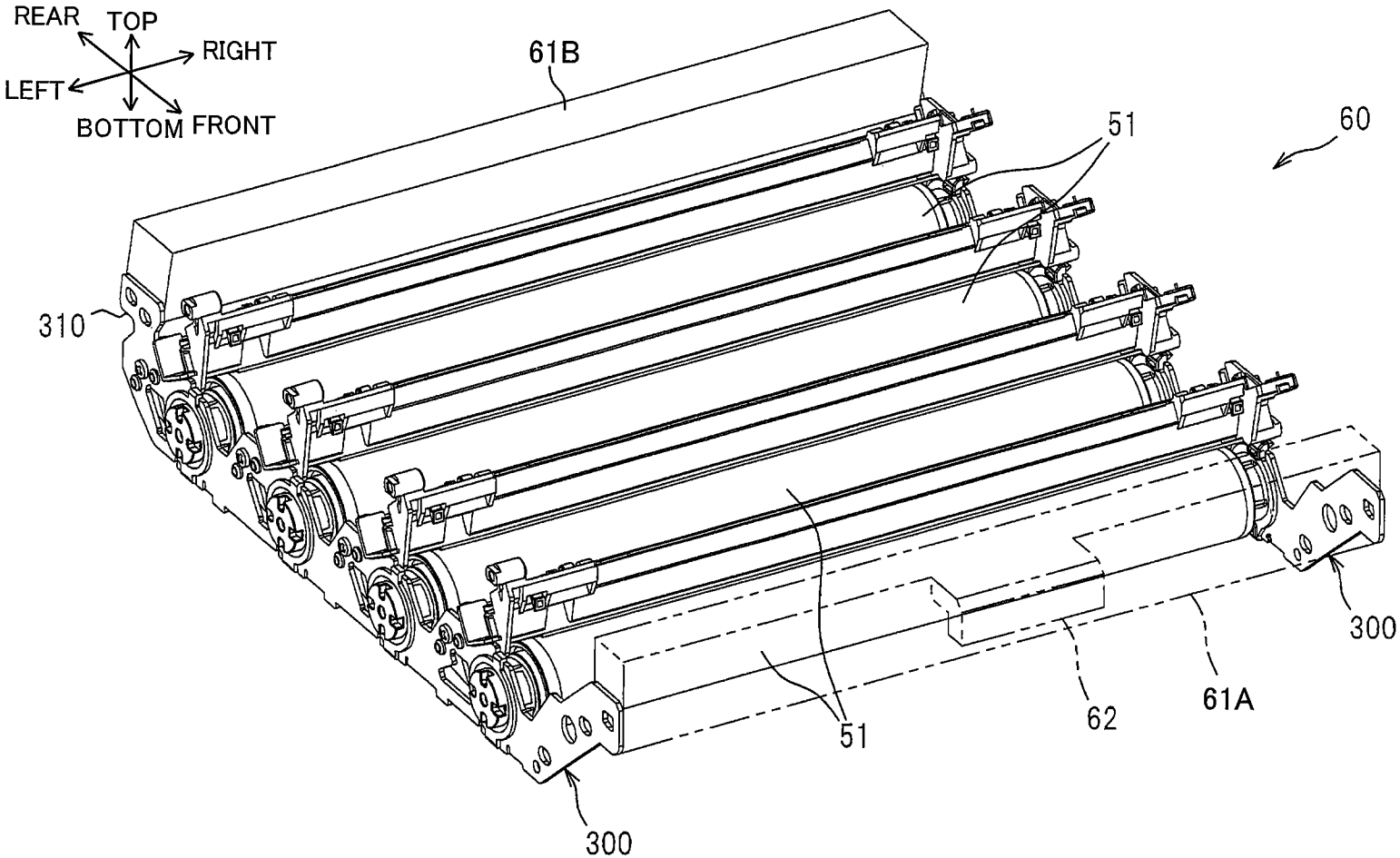
FIG. 3 is a perspective view of the holder and a plurality of photosensitive drums in the color printer according to the embodiment.

Next details of the holder 60 and its ambient structure will be described with reference to FIG. 3. The holder 60 includes front and rear frames 61A, 61B made from a resin, and a pair of right and left metal plates 300. The front frame 61A is spanned between front end portions of the pair of metal plates 300 and is provided with a hand grip 62, so that a user can grip the hand grip 62 to move the holder frontward or rearward. The rear frame 61B is spanned between rear end portions of the pair of metal plates 300.

The pair of metal plates 300 is spaced away from each other in the lateral direction, i.e., axial direction of the photosensitive drum 51 for rotatably supporting the photosensitive drums 51. The metal plates 300 are made from steel, and extend in the frontward/rearward direction, i.e., a direction of an array of the photosensitive drums 51. Each metal plate 300 has front and rear end portions bent upward. Each rear end portion of each metal plate 300 has an upper rearmost portion (downstream end portion in the accommodating direction) formed with a notched portion 310 with which a shaft 230 (described later) is to be engaged.

Figure 5A:
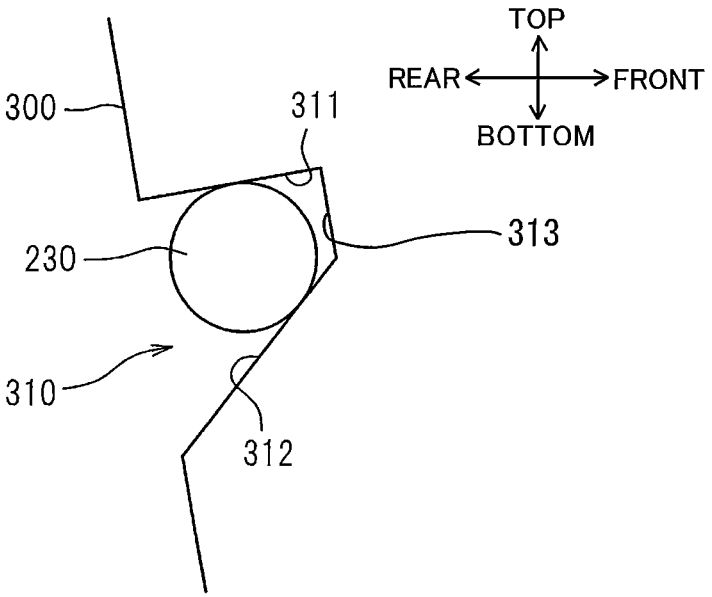
FIG. 5(*a*) is a partial enlarged side view showing the shaft and the holder when the holder is completely accommodated in the main frame in the color printer according to the embodiment.
Figure 5B:
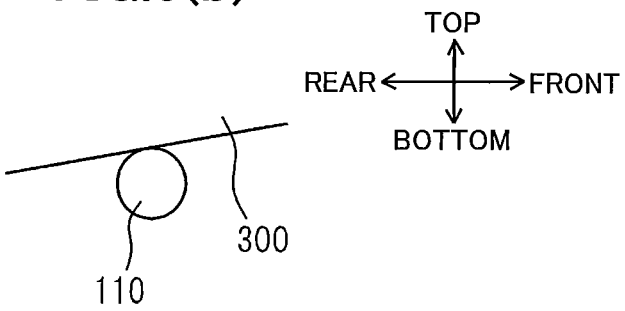

As shown in FIG. 5(*a*), the notched portion 310 is recessed toward frontward from a rearmost end surface of the metal plate 300, and has a first surface 311 extending in generally frontward/rearward direction, a second surface 312 confronting the first surface 311, and a bottom surface 313 connecting the first surface 311 to the second surface 312. The second surface 312 is inclined diagonally downward toward the rear end such that a distance between the first surface 311 and the second surface 312 is gradually reduced toward the bottom surface 313. The notched portion 310 is preferably positioned rearward of the rearmost photosensitive drum 51, as shown in FIG. 1, (most downstream side drum 51 in the accommodating direction) so that the main frame 10 can stably support the holder 60.

As shown in FIG. 4, the main frame 10 includes a pair of resin plate frames 100, a pair of metal plate frames 200, and the shaft 230. In FIG. 4, a left side resin plate frame 100 is not shown for simplicity.

Each metal plate frame 200 is positioned laterally outward of each metal plate 300 when the holder 60 is accommodated in the main frame 10, and is positioned offset from the four photosensitive drums 51 as viewed in the axial direction of the photosensitive drum 51 (in side view). More specifically, each metal plate frame 200 is generally L-shaped in side view and includes a major portion 210 and an extension portion 220. The major portion 210 is positioned above the photosensitive drums 51 and superposed with the scanner unit 40 in side view, and extends in generally frontward/rearward direction. The extension portion 220 extends downward (toward the photosensitive drums 51) from a rear end portion of the major portion 210.

The major portion 210 is formed with three holes 211 arrayed in the frontward/rearward direction for engagement with the three protrusions 42 protruding from the casing 41 of the scanner unit 40, thereby supporting the scanner unit 40 to the major portion 210. The extension portion 220 is formed with a bore 221 through which the shaft 230 (described later) extends.

Figure 6:
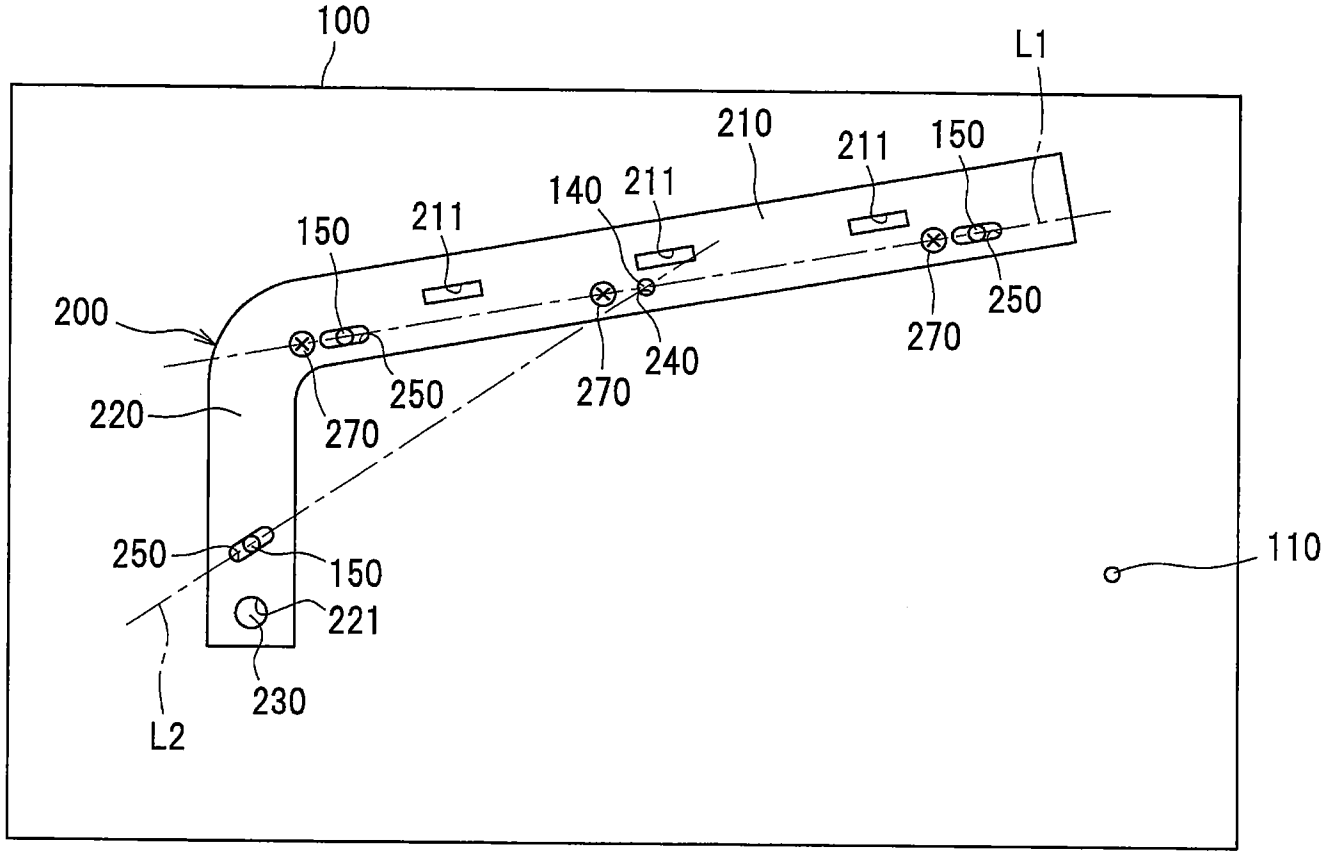
FIG. 6 is a side view of the resin frame and the metal plate frame in the color printer according to the embodiment.

As shown in FIG. 6, the metal plate frame 200 is formed with a single positioning hole 240, three elongated slots 250, and three insertion holes 260 (FIG. 4). The positioning hole 240 extends through a thickness of the metal plate frame 200 and is positioned at a generally longitudinal center portion of the major portion 210. The three elongated slots 250 also extend through the thickness of the metal plate frame 200. Among these, two elongated slots 250 are provided in the major portion 210 and positioned such that the positioning hole 240 is positioned between the two elongated slots 250. Remaining one elongated slot 250 is provided in the extension portion 220 at a position close to the bore 221.

The two elongated slots 250 formed in the major portion 210 and the positioning hole 240 are aligned on an imaginary line L1 extending in a direction parallel to a direction of array of the photosensitive drums 51. Further, elongating direction of the slots 250 is also aligned with the line L1. Further, an elongating direction of the remaining slot 250 formed in the extension portion 220 is coincident with a line L2 described later. Further, as shown in FIGS. 4 and 6, the three insertion holes 260 are adapted to allow screws 270 to pass therethrough. Among these, one insertion hole 260 is positioned adjacent to the positioning hole 240, and remaining insertion holes 260 are positioned adjacent to the elongated slots 250, respectively.

The shaft 230 extends in the lateral direction, i.e., axial direction of the photosensitive drum 51 and is made from a metal. Each end of the shaft 230 is fitted with each bore 221, thereby linking the pair of metal plate frames 200 together.

The resin plate frames 100 are in confrontation with each other and are positioned laterally outward of the pair of metal plate frames 200. Each plate frame 100 has a front inner lower portion force-fitted with a pin 110 made from metal. Each pin 110 is positioned so as to support a front lower end portion of each metal plate 300 when the holder 60 is at the accommodated position.

As shown in FIGS. 4 and 6, the resin plate frame 100 has a positioning boss 140, three projections 150 and three female threads 160. The positioning boss 140 and the three projections 150 protrude laterally inward from a laterally inner surface of each resin plate frame 100. The positioning boss 140 is positioned to fit with the positioning hole 240, and has an outer diameter approximately the same as an inner diameter of the positioning hole 240. The three projections 150 are positioned to fit with the three elongated slots 250. The three female threads 160 are positioned to align with the three insertion hole 260. Thus, the screws 270 passing through the insertion holes 260 are threadingly engaged with the female thread 160.

Here, the above-described line L1 passes through a central axis of the positioning boss 140 and each center of each elongated slot 250. Further, the above-described line L2 passes through a central axis of the projection 150 fitted with the elongated slot 250 formed in the extension portion 220 and the central axis of the positioning boss 140.

The metal plate frame 200 can be positioned to the resin plate frame 100 by fitting the positioning boss 140 with the positioning hole 240 and by engaging the projections 150 with the elongate slots 250. More specifically, by the fitting engagement of the positioning boss 140 with the positioning hole 240, the metal plate frame 200 is temporarily positioned to the resin plate frame 100. Then, by the engagement of the projections 150 with the elongated slots 250, pivotal movement of the metal plate frame 200 about the axis of the positioning boss 140 can be prevented. In this way, the metal plate frame 200 can be positioned to the resin plate frame 100 such that positional relationship between the four photosensitive drums 51 supported to the metal plates 300 and the scanner unit 40 supported to the major portions 210 can be stably maintained.

Incidentally, because each slot 250 is elongated in a direction along the line L1 and L2, a constant distance between the scanner unit 40 and the photosensitive drums 51 can be maintained by relative sliding movement between each projection 150 and each elongated slot 250 even if dimension of the resin plate frame 100 is varied due to its thermal expansion. Then, the metal plate frame 200 is fixed to the resin plate frame 100 by fastening the screws 270 passing through the insertion hole 260 and engaged with the female thread 160.

Figure 2:
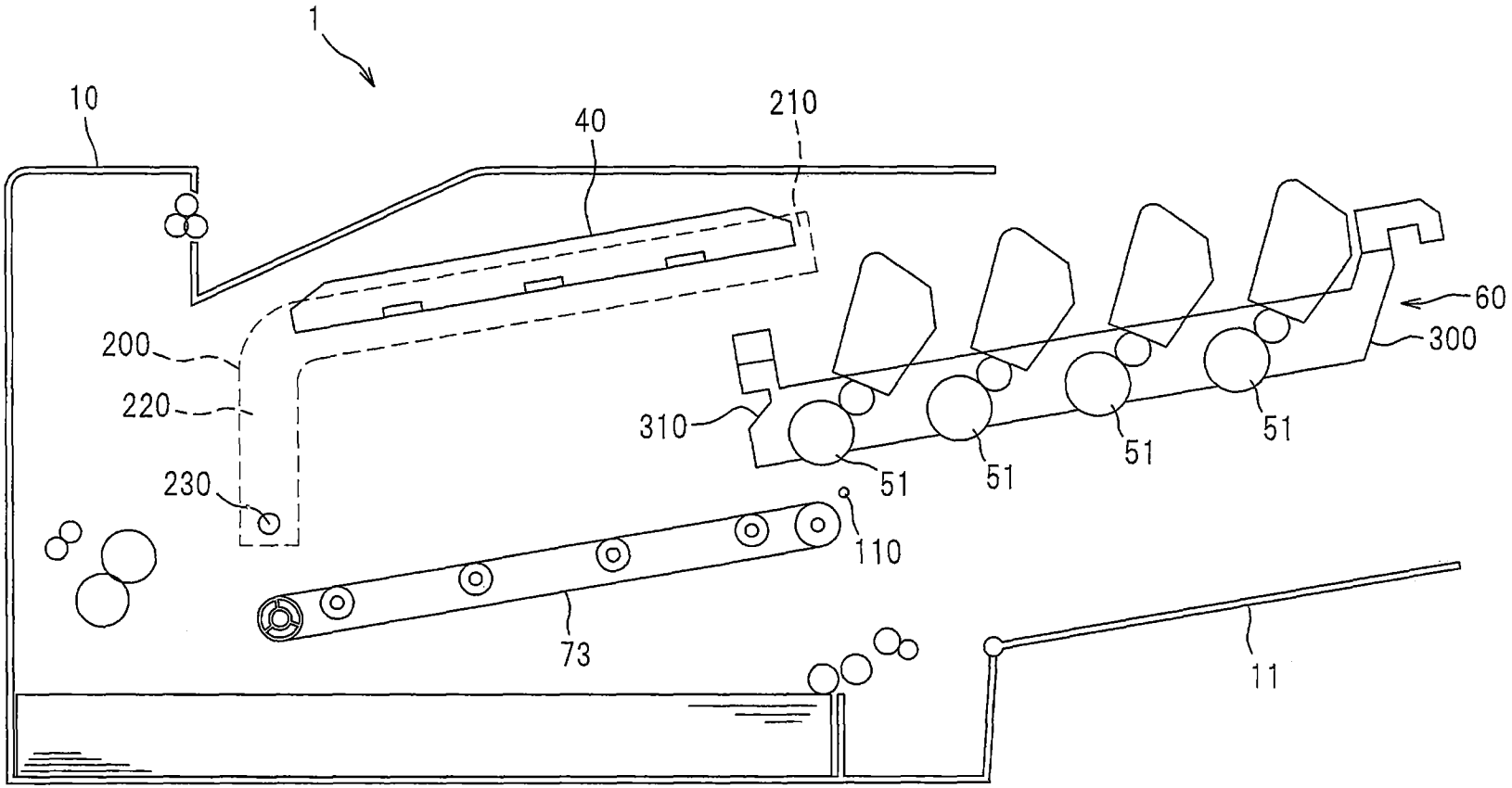
FIG. 2 is a view showing a state where a holder is pulled out from a main frame of the color printer according to the embodiment.

Next positioning of the holder 60 to the main frame 10 will be described. As shown in FIG. 2, for accommodating the holder 60 in the main frame 10, a user opens the front cover 11, and inserts the holder 60 rearward and diagonally downward along the conveyer belt 73. Since the conveyer belt 73 is inclined downward toward the accommodating direction, the holder 60 can be moved downward because of its own weight.

In the accommodating state of the holder 60, the shaft 230 of the main frame side is engaged with the notched portion 310 of the holder side. In this case, the notched portion 310 is in intimate contact with the shaft 230 because of own weight of the holder 60. More specifically, as shown in FIG. 5(*a*), the first surface 311 of the notched portion 310 is in abutment with the shaft 230 from above. Therefore, downward displacement of the holder 60 due to its own weight can be prevented. Thus, vertical position of the holder 60 can be fixed. Further, the second surface 312 of the notched portion 310 is in abutment with the generally upstream side surface of the shaft 230 in the accommodating direction from diagonally below. Therefore, displacement of the holder 60 in the downstream direction (in the accommodating direction) due to own weight of the holder 60 can be prevented. In other word, the shaft 230 is in abutment with the first surface 311 of the notched portion 310 from below, and is in abutment with the second surface 312 of the notched portion 310 from the downstream side in the accommodating direction. Accordingly, frontward/rearward position of the holder 60 can be fixed. Further, since the shaft 230 is nipped between the first and second surfaces 311 and 312, vertical rattling of the holder 60 can be prevented.

While the notched portion 310 is engaged with the shaft 230, each front end portion of each metal plate 300 is seated on the pin 110 as shown in FIGS. 1 and 5(*b*). More specifically, the pin 110 is positioned upstream of the most upstream side photosensitive drum 51 in the accommodating direction, and is in abutment with the metal plate 300 from below to support the front end portion of the holder 60. By this abutment, pivotal movement of the holder 60 about an axis of the shaft 230 can be prevented, thereby stably positioning the holder 60.

In this way, abutment between the notched portion 310 and the shaft 230 and abutment between the metal plate 300 and the pin 110 can provide positioning of the holder 60 relative to the main frame 10, which leads to cost reduction in comparison with a conventional structure where a holder has a positioning shaft and a main frame has a metallic base shaft. That is, although two shafts are provided in the conventional structure in order to position the holder relative to the main frame, in the embodiment, the positioning of the holder 60 is provided by the shaft 230 and the pin 110 which has a lower cost than the shaft of the conventional structure.

Since the metal plate frame 200 constituting a part of the main frame 10 has a minimum area yet accurately supporting the holder 60, the color printer can be produced at lower cost.

Further, since the holder 60 is accommodated in the main frame 10 in the inclined posture, the notched portion 310 can be in intimate contact with the shaft 230 because of the weight of the holder 60. Thus, stabilized positioning of the holder 60 can be provided.

Further, the metal plate frame 200 is generally L-shaped including the major portion 210 supporting the scanner unit 40 and the extension portion 220 through which the shaft 230 extends. That is, the portion for accurate positioning of the holder 60 is constituted only by the metal plate frame 200. Accordingly, the color printer can be produced at low cost because of the compact structure of the metal plate frame 200.

Further, since the metal plate frame 200 is positioned offset from the four photosensitive drums 51 as viewed in the axial direction of the photosensitive drum 51, downsizing of the metal plate frame 200 can be realized.

Further, in a state where the holder 60 is accommodated in the main frame 10, the pin 110 is in contact with the metal plate 300 at a position upstream of the rotation axis of the most upstream side photosensitive drum 51 in the accommodating direction. Therefore, holder 60 can be stably held in comparison with a case where a corresponding pin is in contact with the metal plate 300 at a position downstream of the rotation axis of the most upstream side photosensitive drum 51. Consequently, a distance between the four photosensitive drums 51 and the scanner unit 40 can be stably maintained.

Various modifications may be conceivable. For example, in the above-described embodiment, the second surface 312 of the notched portion 310 is directed diagonally downward and rearward. However, the shape of the notched portion is not limited to this shape as long as positioning of the holder in the frontward/rearward direction can be achieved. For example, an L-shaped notched portion is available such that a surface corresponding to the bottom surface 313 shown in FIG. 5(*a*) can be in contact with the shaft 230 from the front.

Further, in the above-described embodiment, the pin 110 made from a metal is force-fitted with the resin frame plate 100. However, instead of the pin 110, a resin frame 100 plate integrally provided with a protrusion is available, so that the front lower end portion of the metal plate 300 can be seated on the resin protrusion. This modification is advantageous in terms of production cost because of integral molding of the resin frame plate.

Further, in the above-described embodiment, the conveyer belt 73 is provided for conveying the sheet P. However, instead of the conveyer belt 73, an intermediate transfer belt to which a toner image is temporarily transferred is available.

Further, the present invention can also be applied other image forming apparatus such as a copying machine and a multifunction device.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a main frame;

a holder holding a plurality of photosensitive drums arrayed in a predetermined array direction, and movable in an accommodating direction parallel to the array direction to be accommodated in the main frame, the holder comprising a pair of metal plates each positioned at each axial end portion of each photosensitive drum, and each having a downstream end portion in the accommodating direction provided with a positioning portion; and an exposure unit configured to expose the plurality of photosensitive drums to light;

wherein the main frame comprises:

a pair of first side walls made from a resin and positioned outward of the pair of metal plates in an axial direction of the photosensitive drum in a state where the holder is at its accommodated position;

a pair of second side walls each fixed to each first side wall and made from a metal, each second side wall including a major portion supporting the exposure unit, and an extension portion extending from the major portion toward the photosensitive drum; and a linking member linking the pair of second side walls to each other and having an upper contact portion and an upstream-side contact portion, the upper contact portion and the upstream-side contact portion configured to be in contact with the positioning portion when the linking member receives the positioning portion, wherein each of the pair of first side walls has a support portion configured to be in contact with a lower surface of a corresponding one of the pair of metal plates at an upstream side of the linking member in the accommodating direction, wherein when the linking member is in contact with the positioning portion and the support portion is in contact with the metal plate, the holder is fixed relative to the main frame.

2. The image forming apparatus as claimed in claim 1, wherein a combination of the major portion and the extension portion constitutes a generally L-shaped configuration; and wherein the pair of second side walls is positioned offset from the plurality of photosensitive drums.

3. The image forming apparatus as claimed in claim 1, wherein the plurality of photosensitive drums contains a most upstream side photosensitive drum having a rotation axis; and wherein the support portion is in contact with the metal plates at a position upstream of the rotation axis in the accommodating direction.

4. The image forming apparatus as claimed in claim 1, wherein the positioning portion has a first surface positioned above and in contact with the linking member, and a second surface oriented diagonally downward and toward a downstream side in the accommodating direction.

5. The image forming apparatus as claimed in claim 4, wherein the second surface is in contact with the linking member at a position upstream of the linking member in the accommodating direction.

6. The image forming apparatus as claimed in claim 1, further comprising a belt oriented diagonally downward toward a downstream side in the accommodating direction, the holder being movable along the belt.

7. An image forming apparatus comprising:

a main frame including a pair of first side walls made from resin, a second side wall made from metal and fixed to one of the pair of first side walls and a linking member connected to the second side wall, one of the pair of first side walls having a support portion, the linking member having a contact portion; and a holder holding a photosensitive drum and configured to move from an outside position outside the main frame to an inside position between the pair of first side walls in an accommodating direction, the holder including a metal plate disposed adjacent to an axial end of the photosensitive drum and extending in the accommodating direction, the metal plate having a positioning portion disposed adjacent to a downstream end of the metal plate in the accommodating direction, the positioning portion being configured to make contact with the contact portion of the linking member for positioning the metal plate relative to the second side wall, the metal plate being configured to make contact with the support portion for positioning the metal plate relative to the pair of first side walls.

8. The image forming apparatus according to claim 7, wherein the photosensitive drum defines an axial direction, the support portion protruding from one of the pair of first side walls in the axial direction.

* * * * *